United States Patent [19]

Weinar

[11] Patent Number: 4,553,363

[45] Date of Patent: Nov. 19, 1985

[54] OUTSIDE WALLBOARD CORNER CONSTRUCTION AND EDGING MEMBER FOR SAID CORNERS

[76] Inventor: Roger N. Weinar, 19 Parkside Ave., Hamburg, N.Y. 14075

[21] Appl. No.: 421,826

[22] Filed: Sep. 23, 1982

[51] Int. Cl.[4] ..... E04B 1/00; E04C 3/30

[52] U.S. Cl. ..... 52/288; 52/732; 52/718.1

[58] Field of Search ..... 52/287, 288, 716, 717, 52/254, 255, 256, 257, 275, 278, 281, 282, 222, 311, 273, 286, 718, 732, 63

[56] References Cited

U.S. PATENT DOCUMENTS

| | | | |
|---|---|---|---|
| 1,019,951 | 3/1912 | Congill | 52/255 |
| 1,277,319 | 8/1918 | Joice | 52/717 |
| 1,673,971 | 6/1928 | Dowell | 52/255 |
| 2,160,225 | 5/1939 | Newman | 52/281 |
| 2,236,258 | 3/1941 | Burson | 52/285 |
| 2,853,750 | 9/1958 | Davies et al. | 52/273 |
| 3,447,824 | 6/1969 | Brown | 52/281 |
| 3,485,001 | 12/1969 | Miller | 52/281 |
| 3,486,283 | 12/1969 | Arnett | 52/288 |
| 3,606,714 | 9/1971 | Arnett | 52/288 |
| 3,632,146 | 1/1972 | Buzby | 52/278 |
| 3,657,850 | 4/1972 | Billarant | 52/222 |
| 3,742,668 | 7/1973 | Oliver | 52/288 |
| 3,780,479 | 12/1973 | Billarant et al. | 52/63 |
| 3,816,199 | 6/1974 | Dawdy et al. | 52/222 |
| 3,831,334 | 8/1974 | Rutkowski | 52/290 |
| 3,881,293 | 5/1976 | Conville | 52/285 |
| 3,968,989 | 7/1976 | Schippers | 52/280 |
| 3,998,015 | 12/1976 | Scott et al. | 52/222 |
| 4,112,643 | 9/1978 | Decker | 52/222 |
| 4,189,885 | 2/1980 | Fritz | 52/288 |
| 4,197,686 | 4/1980 | Baslow | 52/273 |
| 4,197,687 | 4/1980 | Benoit | 52/262 |
| 4,250,676 | 2/1981 | Presby | 52/222 |

*Primary Examiner*—John E. Murtagh
*Assistant Examiner*—Andrew Joseph Rudy
*Attorney, Agent, or Firm*—Raymond F. Kramer

[57] ABSTRACT

An outside longitudinal corner construction of wallboard panels includes a framing member of the rectangular wooden stud or C-shaped sheet metal channel type, an edging member which is essentially T-shaped in cross-section or of a modified shape and a pair of wallboard panels fitted to the edging member and held to the framing member in such a way that a flap of covering fabric or sheet, as of a prefinished wallboard panel, or a part of the cover paper of such a panel, which cover material had the wallboard core and back removed from it, is wrapped around the edging member T cross-bar and held in position by the other wallboard panel. Thus, the edging member is concealed by the cover material, which is wrapped around it, and the corner construction matches in appearance the rest of the wallboard, with only one discontinuity along the length of the corner on one side thereof, and such is not conspicuous. Also described are edging members incorporating various improvements, such as auxiliary cross-bars, grooves, aligning projections and openings, wallboard holding means adapted to hold wallboards of different thicknesses, a rounded edge on one side of the T cross-bar and a sharper edge on the other side, and pre-deposited adhesive. Procedures for constructing the corners are also disclosed.

9 Claims, 12 Drawing Figures

OUTSIDE WALLBOARD CORNER CONSTRUCTION AND EDGING MEMBER FOR SAID CORNERS

This invention relates to longitudinal corner constructions of wallboard panels. More particularly, it relates to such outside corner constructions which utilize a longitudinally extending edging member which is of T shape or modified T shape in cross-section and in which the finished corner matches the wallboard panels in appearance because of the covering of the edging member by a flap portion of covering material from one of the panels.

Outside vertically extending corners between walls substantially at right angles to one another are desirably smooth, straight, and strong enough to resist being crushed or significantly marred in appearance by contacts with objects accidentally moved against them. When corners are made between a pair of gypsum core wallboard panels which are fastened at right angles to suitable framing members, such as wood or metal studs, the relatively soft and easily crushed panels, which normally have the gypsum or reinforced gypsum core covered with paper (and preferably also have a pre-finished covering, such as one of synthetic organic polymeric sheet plastic on a major surface and sides thereof), are not usually easily cut or finished to produce a smooth straight corner, and the corner resulting, without use of an edging member or corner bead, is easily damaged. To overcome these disadvantages and to make impact resistant corners various types of corner strips have been employed, such as those of L shape, which cover the wallboard at the corner. Such edging members are often unsatisfactory because they do not match the covering on the wallboard panels (which is especially detrimental when the panels are pre-finished) and because they extend beyond the surfaces of both panels. In some instances corner beads have been made which are fastened to the underlying stud at intersecting faces thereof and project so as to meet the exposed surfaces of the wallboards at the intersection thereof, or in some cases project slightly farther so as to allow for troweling on of plaster over the wallboards. While such edging beads may not add a conspicuous projection or ridge to the walls, to hide them and any openings between the wallboard sides such will be plastered over or covered by a matching strip of material. Plastering over metal parts presents a problem because the plaster should be feathered to a thin edge near the corner bead and such thin plaster edges (and plaster in general) do not adhere satisfactorily to metal (plaster does adhere better to paper). Without further work after installation of the corner beads and the wallboards they will give the corner construction an unsatisfactory appearance, which is especially objectionable for pre-finished wallboards, which are desirably of uniform appearance.

The various problems of the prior art methods for making outside corner wallboard constructions have been overcome by the present invention, and the disadvantages of the prior art structures do not result when the present corner constructions are utilized.

In accordance with the present invention an outside longitudinal corner construction of wallboard panels comprises a longitudinally extending framing member having first and second surfaces at about a right angle to each other and extending in the direction of the corner, a pair of wallboard panels, each having core portions covered by cover fabrics or sheets, and an edging member which extends longitudinally in the direction of the framing member and is held to it, directly or indirectly, along its length, said edging member being essentially T-shaped in cross-section or having a part thereof which is essentially T-shaped in cross-section, with a post section and a cross-bar section, said post section or an extension of it being held, either directly or indirectly, to the framing member, a first part of the cross-bar extending from the post in a direction a distance from the first surface of the framing member about the thickness of a wallboard and a second part of the cross-bar extending in an opposite direction from the post, with both cross-bar sections being at a distance from the second surface of the framing member or an extension of the plane thereof about equal to a wallboard thickness plus a wallboard cover thickness, the first wallboard panel being held to the first surface of the framing member and near or against the first part of the edging member cross-bar, with a cover fabric or sheet thereof, which extends beyond said wallboard and said cross-bar, as a flap, being wrapped about the cross-bar, and with the second wallboard panel having a side thereof positioned between the second cross-bar part and the second framing member surface and adjacent the edging member post, and holding the cover fabric or sheet of the first wallboard panel in position between the second cross-bar part and the second wallboard panel. Also within the invention are longitudinally extending edging members which facilitate the constructions of the described corners and which include improvements over the basic edging members which are T-shaped in cross-section. Processes for construction of outside longitudinal corners of wallboard panels, utilizing the mentioned edging members, are also disclosed and are within the invention.

A search of the prior art has failed to reveal any references disclosing the present invention or making it obvious to one of ordinary skill in the art. Among the art found in such search are U.S. Pat. Nos. 3,485,001; 3,657,850; 3,780,479; 3,816,199; 3,831,334; 3,998,015; 4,112,643; 4,197,686; and 4,250,676. Of these U.S. Pat. Nos. 3,816,199, 4,112,643 and 4,197,686 disclose a covering member being employed to conceal portions of wall assemblies, and U.S. Pat. No. 3,485,001 describes an edging strip that is utilized for holding wallboard panels in position at a butted corner between them. However, combinations of the disclosures of such references would not teach the present invention nor would such a combination make the invention obvious. It is notable that no reference teaches utilization of a wallboard cover flap in an outside corner construction to conceal such construction along the surface of one of the corner wallboards and none shows such concealing along a side of such wallboard and a second wallboard, with the second wallboard holding the flap in position (and preferably pulling it tight as the second wallboard is slid into place).

The invention will be readily understood by reference to this specification, including the description of preferred embodiments thereof, as shown in the drawing, in which.

Figure 4:
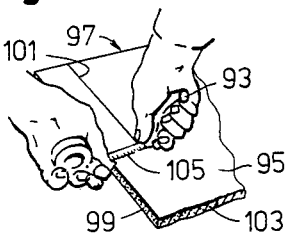
Figure 5:
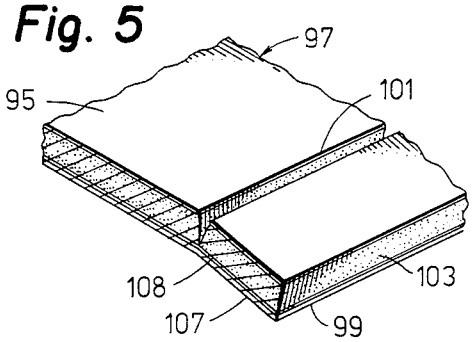
Figure 6:
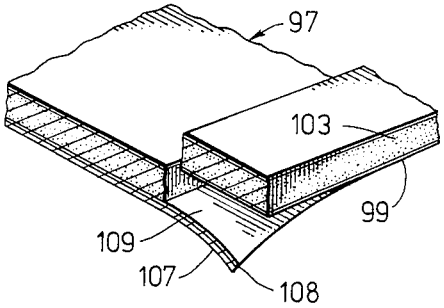
Figure 7:
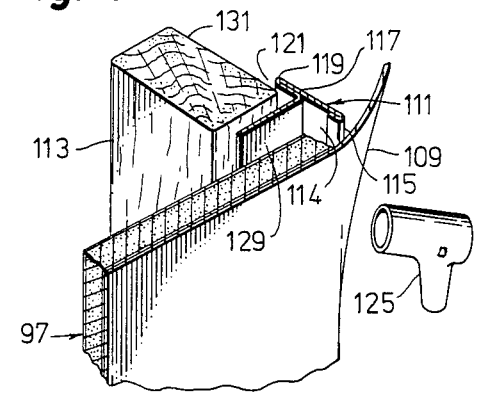
Figure 9:
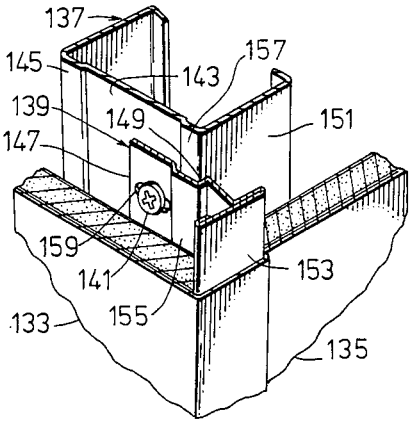
Figure 8:
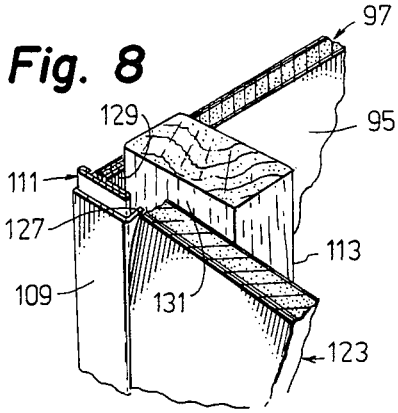
Figure 10:
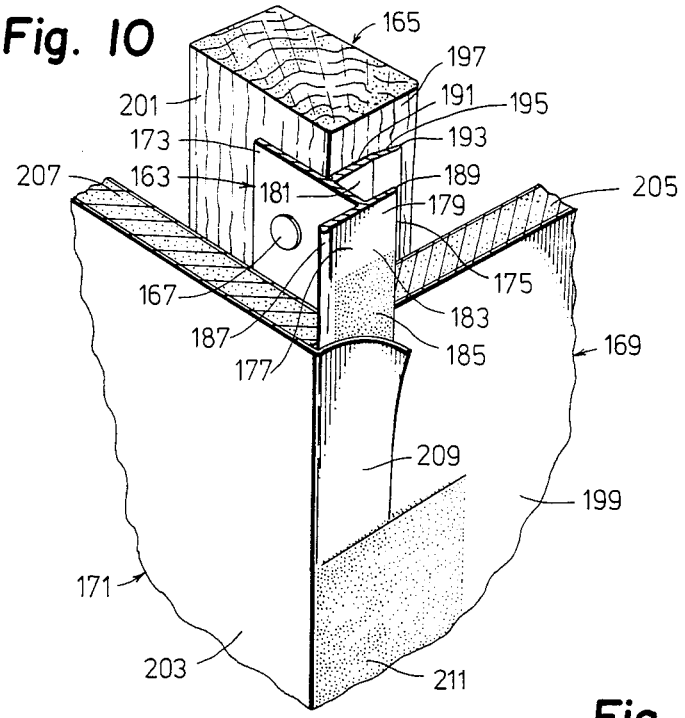
Figure 11:
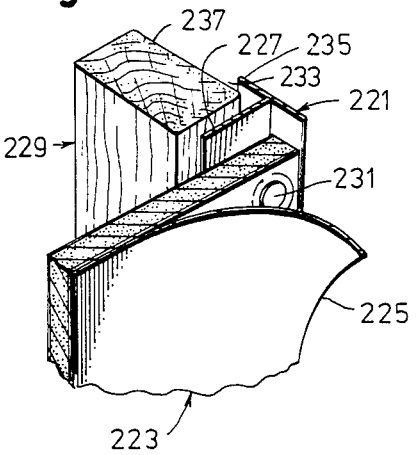
Figure 12:
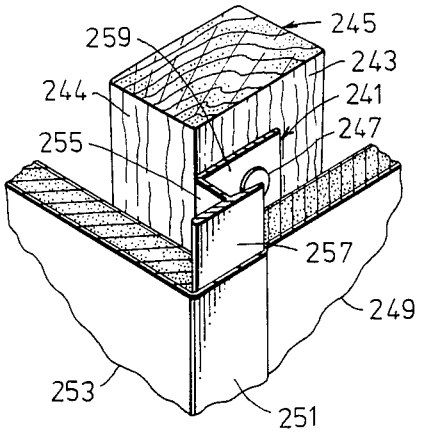

FIG'S. 4–8 illustrate preparation of a wallboard cover flap at the side (or end) of a wallboard, and installation of such a wallboard and a second wallboard to produce a structure essentially like that of FIG'S. 1–3;

FIG. 4 is a perspective view illustrating scoring of a back (unfinished) surface of a wallboard panel so as to weaken the panel so that when it is bent at the score line the removal of the gypsum core and back cover paper to produce a concealing flap will be facilitated;

FIG. 5 illustrates bending of the wallboard along the score line to separate the back cover paper and to break the core;

FIG. 6 shows the removal of part of the back cover paper and all of the core from the front cover of the wallboard panel along the side thereof;

FIG. 7 is a partial cutaway perspective view of a wallboard like that of FIG'S. 4–6 installed against a T-shaped bent metal edging member and a wooden framing stud with the flap being heated to soften it so that it can readily be bent around the edging member;

FIG. 8 is a similar perspective view but from a different angle, showing insertion of a second wallboard into position between the edging member and a second surface of the framing stud, which wallboard insertion forces the flap into position between the edging member and the wallboard, holding it tightly in place;

FIG. 9 is a partially cutaway and sectioned view of a corner construction of this invention wherein the post section of the modified T-shaped edging member adjustably conforms to a C-shaped metal stud having a channeled side;

FIG. 10 is a partially cutaway perspective view of a corner construction in which there is employed a modified edging member of rigid polymeric plastic, which is adaptable for use with wallboards of different thicknesses, and in which the cover flap of the wallboard is of paper, is adhesively held to the edging member, and has gypsum joint compound or plaster covering it after installation;

FIG. 11 is a partially cutaway perspective view of a corner construction in which the wallboard panel and edging member are held to a framing member by means of a fastener which is subsequently covered by return to initial position of a portion of a peeled back wallboard cover flap; and FIG. 12 is a partially cutaway perspective view of a corner construction in which a modified edging member is employed, which allows for installation of the corner member after the first panel, containing the cover flap, has been installed an allows fastening of the edging to a different stud face.

Figure 1:
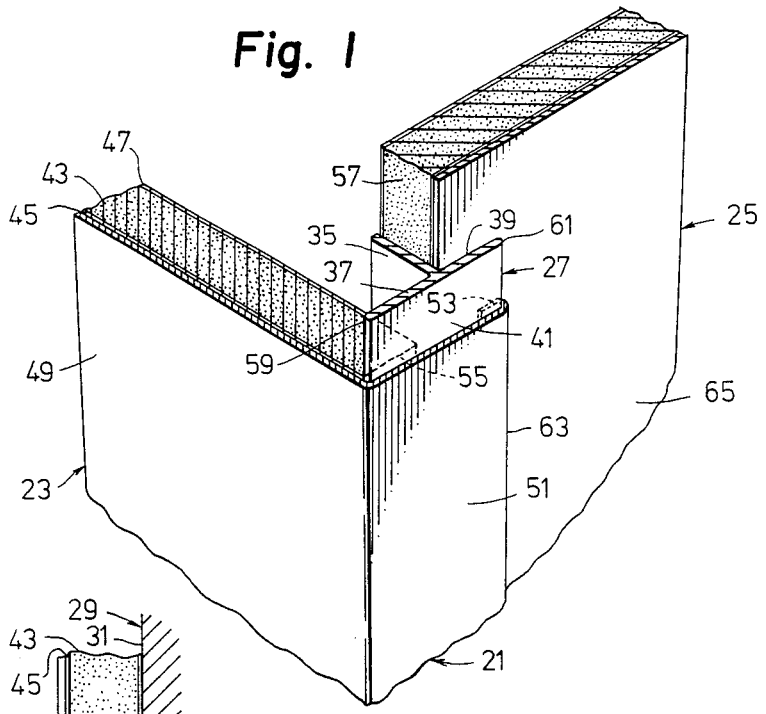
FIG. 1 is a partial top front perspective view of a wallboard corner assembly, with one of the wallboard panels partially cut away and with a framing member or stud to which at least one of the panels is normally secured being omitted to better illustrate the relationship to the panels of an elongated longitudinally extending edging member, strip or runner.

In FIG. 1 an outside longitudinal (vertically extending) corner construction 21 of wallboard panels 23 and 25 is shown assembled with the aid of longitudinally extending edging member 27. Framing member 29, shown in FIG. 2, includes first surface 31 and second surface 33, which are at right angles to each other, but for the sake of clarity so that more details of edging member 27 and wallboard panel 25 may be shown, framing member or wooden stud 29 is omitted from FIG. 1. Edging member, strip or runner 27 includes a post section 35 and first and second cross-bar sections 37 and 39, respectively, which cross-bar sections, run from post 35 at about a right angle thereto, and together with the extension of such post, form the cross-bar 41. Wallboard panel 23 includes a core 43 of gypsum or comparable material, paper sheet covers 45 and 47 on front and back major surfaces of the wallboard and covering the core, and a pre-finished, preferably oramental of decorative external front cover 49, preferably of flexible synthetic organic polymeric plastic material, such as polyvinyl chloride. Wallboard panel 25, positioned approximately at a right angle to wallboard 23, includes core, paper sheet covers and front decorative cover of pre-finishing material like those of wallboard 23, so such will not be numerically identified. About the "exterior" of the cross-bar 41 of edging member 27 (which is preferably made of a substantially form-retaining material such as rigid polyvinyl chloride, which does possess a certain measure of flexibility) is wrapped cover flap 51, which had been separated from the core and paper covers of a side section of wallboard 49 which had previously been removed (when the wallboard side has not previously been cut off the flap also derives from the panel side cover and a portion of cover at the back of the wallboard panel and adjacent to such side). As illustrated, the flap includes only the external plastic extension of cover 49, with the inner front paper 45 being considered to have been retained with the removed portion of core 43. However, sometimes it is noted that portions of an extension of paper cover 45 will adhere to flap 51 and in some cases substantially all of such extension will adhere to such flap. The illustration is not meant to exclude such flaps from preferred embodiments of the invention.

Figure 2:
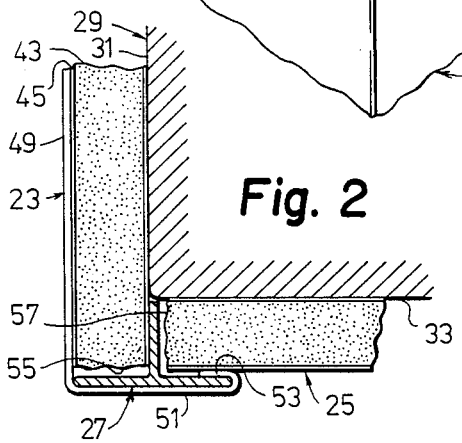
FIG. 2 is a partial horizontal sectional view of a corner construction like that of FIG. 1, showing how the wallboard panels and the edging member relate to a framing stud and to each other.

End portion 53 of flap 51 is shown folded around end 61 of second cross-bar part 39 and wallboard panel 25, and inserted between cross-bar part 39 and post portion 35 of edging member 27 and second stud face 33 (FIG. 2, not illustrated in FIG. 1), so that end portion 53 of flap 51 is held in position between the "back" surface of second cross-bar part 39 and the front pre-finished surface of wallboard panel 25. As illustrated, wallboard sides 55 and 57, shown in preferred positions, are in contact, respectively, with the back surface of the first cross-bar part 37 and a face of post 35, but it is within the invention for such wallboard sides (or ends) to be adjacent to such parts but not in contact with them, as shown in FIG. 2. As illustrated, the end 59 of the first cross-bar part 37 is rounded so as not to unduly strain and perhaps weaken cover flap 51, where it is in contact with edge member 27 at such corner. As shown, the end 61 of second cross-bar part 39 is similarly rounded but it is within the invention to taper said second cross-bar part to a thin section at the end thereof so as to minimize the noticeability of the line of demarkation between the cover flap, where it is bent about the edging member at end 61 (shown visibly as end 63), and front surface 65 of wallboard panel 25.

In FIG. 2 is shown a construction essentially the same as that of FIG. 1 and hence the same numerals are employed. However, a minor change is illustrated with respect to the ends 55 and 57 of wallboard panels 23 and 25, respectively, which are shown slightly spaced away from portions of edging member 27, rather than in contact with them as in FIG. 1. Also, although the fastening means, which may be an adhesive or other suitable fastener, is not specifically illustrated, in FIG. 2 panel 23 is fastened to surface 31 of framing member 29.

Figure 3:
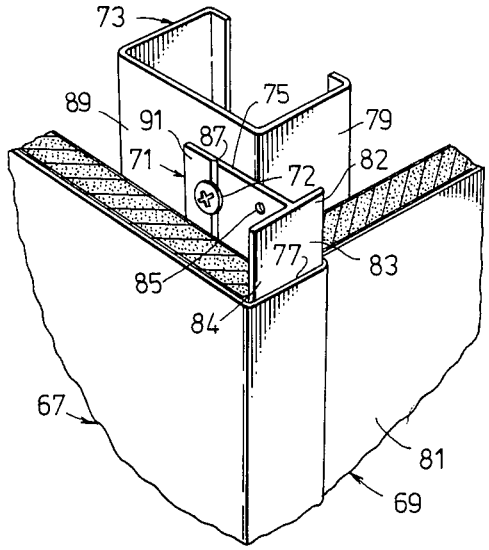
FIG. 3 is a partial sectional view of a corner construction like that of FIG'S. 1 and 2 but with a metal C-shaped stud or framing member and a modified edging member being illustrated.

In FIG. 3 a wallboard panel corner construction of this invention like that shown in FIG'S. 1 and 2 is illustrated, but with several changes. Thus, wallboard panels 67 and 69 are shown with modified edging member 71, which is held, by drive screw fasteners like that identified by numeral 72, to C-shaped metal channel stud 73. As shown in FIG. 3, the post portion 75 of edging member 71 extends for a distance greater than the thickness of wallboard 69 (which thickness includes the core and covers thereon), and greater than the thickness of wallboard 69 plus a compressed cover portion 77 of the exposed major surface of wallboard panel 67. Edging member 71 is so positioned with respect to the second surface 79 of stud 73 that insertion of wallboard 69 between said surface and the parallel cross-bar second part 82 of edging member 71 will be a tight fit so that the part of the cover flap 77 between such edging member and the front surface 81 of panel 69 will be tightly held in place.

While the cross-bar portion 83 (including first and second parts 84 and 82) of edging strip 71 is essentially the same as the cross-bar shown in FIG'S. 1 and 2, the post portion 75 of the T-shaped edging member includes two modifications, as shown. One of these is an aligning means 85, shown as a hole in post portion 75, which hole is so located that a nail or other thin and relatively long object may be inserted in it to indicate the proper positioning of the edging member with respect to the second surface 79 of stud 73, so that a panel of a particular thickness and a flap of a particular cover thickness may be held between surface 79 of the stud and cross-bar 83 (or second cross-bar part 82). Of course, instead of opening 85, other means, such as lines, ridges, scribe marks, grooves, and other indicia may also be employed and a plurality of such may be used to indicate proper locations of the edging member for different thicknesses and types of wallboards, so as to make the edging members useful with a variety of wallboard panels (not requiring different edging members for different sizes of panels). Longitudinal groove 87 is shown, which extends the length of edging member 71. Such groove helps to prevent walking or run-off of drive screws 72 or other appropriate fasteners which may be employed to join edging member 71 to stud 73 in desired position before installation of panel 69, and usually before installation of panel 67. Instead of longitudinal grooves, interrupted grooves, indentations or perforations may be employed for the same general purpose.

Although not shown, panel 67 is appropriately fastened to stud 73. Such fastening may be by screws, nails (when wooden studs are utilized), rivets, staples or other suitable means, or adhesives may be employed. The fastening of panel 67 may be directly to an appropriate part of first surface 89 of stud 73 or may be indirectly to such stud by cementing of the panel to surface 91 of post portion 75 of edging member 71.

In FIG'S. 4–8 various steps in the assembly of a corner of this invention are shown, starting with the preparation of the cover flap of a wallboard panel at a side of such panel which is to be installed as a part of the invented corner construction, and ending with the insertion of a second panel into position with respect to the first panel, a framing member and an edging member. In FIG. 4 there is illustrated scoring with a knife, the handle of which is shown at 93, of the back surface 95 of a wallboard panel 97 at a desired distance from the previously cut or broken side 99 of the panel. Score mark 101 cuts through the back cover 95 of panel 97 (which cover is usually a paper sheet glued to a wallboard core 103, which core is normally of gypsum) and may also partially cut through core 103. As illustrated, the desired distance of score line 101 from side 99 of panel 97 is measured by means of a metal tape rule 105 and the line is made by holding the tape even with side 99 and holding the knife so that the blade thereof (not visible in FIG. 4) makes the desired score line parallel with side 99, as the tape and the knife are moved along the wallboard, with the knife blade being at the desired fixed distance from side 99 during such movement. Instead of utilizing the method described for scoring the back of the wallboard panel other techniques may also be employed. For example, the paper backing 95 may be printed with parallel lines and scoring may be along one of said lines or between them, by means of any appropriate sharp instrument. Alternatively, a straight edge may be used to guide the knife or the cut may be made "by eye". Normally end 99 will previously have been cut so that it will not include a pre-finished cover (the front surface of panel 97 is covered with a pre-finished fabric or sheet material, normally of synthetic organic polymeric plastic, such as polyvinyl chloride, but such is not seen in FIG. 4, although it is illustrated in FIG'S. 5–8). Also, there will usually be a paper sheet between the core and the pre-finished plastic sheet or fabric, which is not shown in FIG. 4 but is illustrated in FIG'S. 5 and 6 (it is not specifically shown in FIG'S. 7 and 8 but is considered to be present). If side 99 is not one that has been cut, and if the pre-finished plastic is wrapped around it and down a short length of the back of the wallboard panel, the scoring of the back will be at a different distance from side 99 to obtain the desired flap length, but it is not considered necessary to discuss this matter further because the situation referred to is comparatively rare and the modification of the procedure is considered to be self-evident in view of the previous discussion.

In FIG. 5 wallboard panel 97 is shown with score line 101 having been opened by bending of the portion of the panel near side 99, which causes the gypsum core, which is relatively weak in tension, to crack and separate, as shown. It will be observed that in FIG. 5 neither the pre-finished vinyl (or other suitable material) decorative cover 107 for the front of the panel nor the paper or other such sheet 108 is torn or separated. However, the paper sheet may sometimes remain partially (even completely, in contact with the gypsum core). FIG. 6 illustrates removal of the side portion of the panel core and adhering paper backing from the rest of the panel, leaving a flap 109.

In FIG. 7 wallboard panel 97 is shown in position against edging member 111 and framing member 113. The framing member illustrated is a vertical wooden stud and the edging member, as shown, is bent into a T form from a piece of metal strip or sheet. Edging member 111 may be held to stud 113 by appropriate fasteners, not illustrated, or by an adhesive, and in some cases may be held between stud 113 and panel 97 by the pressure of the panel against the stud, to which the panel may be fastened by suitable means. One way of fastening both the edging member and the panel to the framing member is illustrated in FIG. 11, wherein a nail is driven through the wallboard, except for the cover member, and through the edging strip into the framing member. Of course, when substantially rectangular framing member 113 is located so that its longer dimension is along panel 97 it is easier to join the panel to the framing member, as by means of an adhesive, without positively fastening the edging member to the stud.

However the edging member and panel are held to the framing member, after proper positioning of the panel and the edging member, cover flap 109, which may be the outer cover flap alone, usually of PVC, or such flap and an inner layer or sheet of paper to which it adheres, is bent around rounded corner 115 of the edging member cross-bar 114, along the cross-bar outer surface 117, around rounded corner 119 and into a space 121 between the cross-bar and the framing member. Of course, the flap should be long enough so that when it enters space 121 there is enough of it to be pressed against the cross-bar when panel 123 (FIG. 8) is inserted, and yet not so much as to interfere with the insertion of such panel. To facilitate bending of the pre-finishing cover sheet about the corner or edge 115 it is desirable to warm such thermoplastic sheet at the corner before bending, thereby preventing possible cracking of the sheet during or after installation. Warming along the length of the edging member, as by a blower-heater, such as that illustrated at 125, which may heat the the plastic sheet to a suitable temperature, usually 35° to 50° C., facilitates the obtaining of an uncracked smooth and excellently adherent cover on edging member 111. Of course, such heating is also desirable for bending the cover flap 109 about corner 119. Flap 109 may be positively held to the cross-bar surface 117 of edging member 111 by an adhesive applied to such surface before wrapping the flap over it. Such adhesive may be pressure sensitive and the edging members may have such adhesive preapplied to the cross-bar outer surface and protectively covered by a removable strip, not shown, which is removed just before wrapping of the flap around the edging member.

In FIG. 8 the final step in the corner construction is illustrated. With panel 97 and edging member 111 held to stud 113 and with flap 109 having been wrapped around the edging member so that the end thereof 127 is in the space between the edging member and the framing member, panel 123 is moved into position against or near to the post portion 129 of edging member 111. Because the clearance 121 (FIG. 7) between the edging member cross-bar and the surface 131 of the framing member has been properly chosen, insertion of panel 123 will pull flap 109 into place and will hold it between the panel and the edging strip. It is not necessary for the panel to be otherwise positively held to the stud, although, if desired, adhesive may be applied to either the panel or the stud before insertion of the panel. However, if adhesive is not used the corner construction is more readily disassemblable, as by removal of panel 123, unwrapping of flap 109, withdrawal of any fasteners used to hold the panel 97 and/or edging member 111 to stude 113, and removal of edging strip 111 and panel 97.

The corner construction shown in FIG. 9 is one in which first panel 133 and second panel 135 are held to what may be termed a C-shaped metal stud 137 by edging member 139, which is fastened to the stud by screw 141. Channel 137 includes a depressed area 143 on its first or major surface 145 and therefore edging member 139, which is shown as a bent strip of metal, somewhat like the edging member of FIG. 7, has its post portion 147 shaped accordingly, with a shoulder or stop section 149, which bears against the second surface 151 of the metal stud 137, thereby preventing installation of the edging member 139 with its cross-bar 153 too close to surface 151 of framing member 137. However, the post portion 147 of edging member 139 does have a channel-shaped part 155 thereof extending farther than ridge 157 of the metal stud (plastic studs of similar external structure may also be employed). Thus, adjustment of the position of the edging member with respect to the stud is possible, to allow for the use of thicker second wallboard panels than the minimum, and slot 159 permits positive fastening of the edging member to the framing member in desired position. Of course, a plurality of slots will usually be present over the length of the edging member, at whatever distance apart is deemed best for particular structures, so as to provide suitable openings for insertions of fasteners 141 (or equivalent fastening means). If desired, the slots may be omitted and drive screws or sheet metal screws may be installed at any suitable location to hold the edging member in place (or it may be held, and the wallboard may be held by other fastening means, including adhesive material) on the wallboards. Except for utilization of a modified edging member, with stop and adjustable fastening provisions, and the use of a metal channel as the framing member, the corner construction is like that previously illustrated and accordingly, it will not be described further.

In the corner construction illustrated in FIG. 10 edging member 163, fastened to vertical wooden stud 165 by nail 167, holds wallboard panel 169 in position and helps to hold panel 171 in place, so as to form a corner construction of this invention. Edging member 163 includes a post portion 173, a cross-bar portion 175, which has first and second cross-bar parts 177 and 179, and an auxiliary cross-bar 181, which extends from the post 173 in the direction in which the second cross-bar part 179 extends. As shown, cross-bar 175 has on the outer surface thereof, which will be designated 183, a thin layer of adhesive 185, preferably of the pressure sensitive type. Cross-bar part 177 is rounded at an end thereof 187 and second cross-bar part 179 is tapered to a relatively thin edge at end 189 thereof, so that any division line between a wallboard cover flap and the outer surface 199 of panel 169 will be as inconspicuous as possible. Yet, of course, the tapering of cross-bar part 179 will not be so severe as to cause the cutting of a cover flap when such is bent around the end 189 of edging member 163.

Auxiliary cross-bar 181, as illustrated, includes an inner part 191 which is substantially parallel to the inner surface of cross-bar part 179 and about a distance from such inner surface equal to the largest thickness of a wallboard panel which the edging member is designed to hold (plus a wallboard paper cover thickness). Toward the end 193 of auxiliary cross-bar 181 it is tapered and headed toward the second wallboard panel. Directing of the cross-bar toward the installed panel is effected to adapt the edging member to fit panels of various thicknesses. Thus, when a full thickness panel is employed the tapered part 195 of the auxiliary cross-bar member will be pressed against the second surface 197 of stud 165 but when a panel of lesser thickness is employed, the bar retains its initial shape or is bent only slightly, thereby accommodating such panel and holding it against the back of the second cross-bar part 179 of the edging member. Thus, the flap 209 from the first panel 171 will be tightly held in place between the second panel outer surface 199 and the inner or back surface of the second cross-bar part 179.

Adapting the edging member for use with wallboards of varying thickness is not as much of a problem with respect to the installation of the first wallboard, which abuts a different inner or back surface of the cross-bar, because when the flap member is drawn tightly into position a good corner is made where it is drawn past rounded edge 187 of the edging member. However, if desired, a portion of the edging member at 187 may be shaved off or a shim may be placed between the first surface 201 of framing member 165 and the hidden part of the post portion 173 of edging member 163, before installation of the edging member by means of fastener nail 167 (and other fasteners or equivalents, which may also be employed). Instead of the type of auxiliary cross-bar 181, employed to adapt the edging member 163 to fit various thicknesses of wallboard panels, other auxiliary cross-bars may also be employed for the same purpose. For example, such auxiliary cross-bar may be tapered along its entire length, may be of a distortable material, may be resilient, with a cushioning material between it and the second stud surface, or may be notched near the post portion of the edging member so as to facilitate bending thereof to conform to the surface of a wallboard panel (such notching being employed to make the auxiliary cross-bar part more flexible so that it can better conform to the wallboard panels being used). Of course, combinations of such features are also possible and may be desirable. Alternatively, the auxiliary cross-bar part may extend parallel to the main cross-bar and may be designed so as not to flex. In such embodiment of the invention any adapting to different size wallboard panels may be effected with shims or strips placed behind the panel being inserted. It will be noted that the auxiliary cross-bar serves in part as a stop, preventing the edging member from being positioned with the cross-bar too close to the stud. In this respect it functions somewhat like the stop for the edging member mentioned in the description of FIG. 9, and in some cases the cross-bar may be shortened, such as to a length of from about 0.2 to 1 cm. or 0.4 to 0.8 cm., so that its main function will be to act as a stop, and to facilitate ready installation of the edging member.

The procedure for installation of the panels shown in FIG. 10 is that previously described with respect to FIGS. 4–8, with a few exceptions. It will be noted that panels 169 and 171 are not pre-finished with a polyvinyl chloride or other decorative fabric or sheet cover. Rather, such panels are ordinary wallboards, having the normal paper covers or surfaces 199 and 203 over cores 205 and 207. Paper flap 209 is installed in the normal manner, after positioning of wallboard 171, with care being taken so that it will be smoothly affixed to adhesive 185 on cross-bar surface 183. Preferably, such adhesive was exposed, by removal of a cover strip not shown, only shortly before wrapping of flap 209 around cross-bar surface 183. After installation of panel 169 in such manner that the end of flap 209 is held firmly in place in relation to the edging member, the corner portion of the flap and a part of the outer paper surface 199 of wallboard panel 169 may be coated with plaster or gypsum joint compound, as shown at 211. Paint and wallpaper adhere readily to such coating and the plaster or joint compound adheres well to the papers of the flap and the second wallboard surface, thereby facilitating the ultimate production of a corner construction wherein paint, wallpaper and other coverings are applied without leaving telltale seam lines showing.

FIG. 11 is very much like FIG. 7 and accordingly will not be described except for the differences between them. Note that the edging member 221 is of a synthetic organic polymeric plastic material, such as "rigid" polyvinyl chloride, and wallboard panel 223, with flap portion 225 thereof pulled back, is fastened to post portion 227 of edging member 221 and to wooden stud 229 by nail 231, which is subsequently concealed by flap 225 when it is wrapped around edging member 221 and fitted into opening 233 between the cross-bar portion 235 of the edging member and surface 237 of the stud.

The corner construction of FIG. 12 is like that of FIGS. 1 and 2, but one difference is in the edging member 241 being of a bent strip of metal, instead of being a unitary molded or otherwise formed synthetic organic polymeric plastic article. Also, edging strip 241 is held to surface 243 of stud 245 by nail 247 and surface 243 of stud 245 is that surface of the stud which is nearest to second wallboard panel 249 when it is inserted between stud surface 243 and cross-bar 257 of edging member 241 to complete the corner construction and to hold a flap portion 251 of a wallboard cover from wallboard panel 253 in place between the edging member and the second panel. As shown, edging member 241 includes a post portion 255, a cross-bar portion 257 and an auxiliary cross-bar 259, which extends from post 255 in a direction substantially parallel to that of cross-bar 257, and which extends far enough past such cross-bar so as to permit and facilitate ready mounting of the edging member on the stud, which can be of importance in situations when applying a fastener to the stud surface 244 nearer to wallboard panel 253 may be inconvenient. Because the distance between the cross-bar and the auxiliary cross-bar of edging member 241 is equal to the thickness of wallboard panel 249 plus cover flap 251 (or very close to such total thickness, and sometimes less than it to promote tight holding), auxiliary cross-bar 259 acts as a stop and as a guide for positioning the edging member, in addition to acting as a mounting means, thereby facilitating easy installation of the edging strip without need for measurement.

Although it is highly preferred that the corner construction of this invention be made utilizing a rectangular wooden stud or a C-shaped metal channel stud, pre-finished gypsum wallboards having a flexible polyvinyl chloride decorative coating thereon, and an extruded rigid polyvinyl chloride or bent sheet metal edging member, the invention is applicable to other materials of construction, too. For example, the studs can be of other shapes, with rounded corners, stepped sides or faces with channels or depression in them, in which cases the edging members may be modified accordingly. Synthetic organic polymeric plastic studs, such as those made from polyurethane, polystyrene, polypropylene or glass fiber reinforced polyesters or polyethers may be used. The wallboards may be coated composition boards or coated particle boards and in some cases they may be of wood or may be of coated metal or plastic sheets about foamed plastic cores. Instead of PVC other decorative plastic sheets may be used, such as those of polyurethane, polythylene, polyester, e.g., Mylar®, or other suitable material. While it is preferred that the covering on the wallboard or other panel base be vinyl or other thermoplastic over paper, other materials may be used, such as woven fabrics, and the covering may be directly on the core material. Also, other base coatings may be used instead of paper. Covering materials may be of other synthetic or natural materials, including papers, and may be printed or otherwise decoratively finished. Instead of rigid PVC plastics may be employed for the edging members, when such are extruded, pressed, molded or otherwise manufactured, including polypropylenes, polyethylenes, polystyrenes, nylons, polyethers, polyesters (these may sometimes be fiberglass reinforced), hard rubbers and ABS, so long as they are sufficiently form retaining as to be able to tightly hold a wallboard panel in place and to form a suitable impact resistant edge at the corner between the wallboard panels. While steel is usually the metal of choice for bent strips for the edging members (and may preferably be galvanized), aluminum and various metal alloys may also be used, and aluminum extrusions can be substituted. Various types of fasteners may be used, including nails, screws, sheet metal screws, drive screws, rivets, staples, and the adhesives that are employed may be of solvent, fusible, chemically reactive or other types.

Although the invention is not to be considered as limited to corners and elements thereof of particular sizes, normally the wallboard will be of a thickness in the range of 0.6 to 2.5 cm., preferably from 0.9 to 1.9 cm., and the panels will usually measure about 1.2 m. by 2.4 m. or 1.2 m. by 2.1 m. (with widths usually being less at the corners).

The paper or other base cover on the wallboard panels will be of a thickness which is usually in the range of about 0.05 mm. to 2 mm., preferably, 0.1 mm. to 1 mm., and the pre-finish fabric or other material covering may be of a thickness in the range of 0.05 mm. to 5 mm., preferably 0.2 to 2 mm. The thicknesses of the post, cross-bar and auxiliary cross-bar portions of the edging members will normally be within the range of 0.8 to 2.5 mm., preferably, 1 to 2 mm., e.g., 1.5 mm. but it is understood that the various mentioned parts may be tapered to lesser dimensions. Also, the protective corner portion of the cross-bar may be half rounded instead of fully rounded, providing that it does not make a unduly sharp corner so as to cause cutting of the covering sheet. The post of the edging member will usually be no more than 5 cm. long and preferably such length will be 2 to 4 cm. Dimensions of the cross-bars will depend to some extent on dimensions of the panels being installed. Any openings or slots in the edging member post portion will be set apart convenient distances for fast and firm installation. Normally, such distances will be about 8 to 40 cm., preferably 15 to 30 cm. apart. The studs or other framing members (because the corners may be horizontal as well as vertical) will normally be what are referred to as 2×4's, which measure about 3.8 cm. by 8.8 cm. but other sizes may also be used.

A method for the installation of the present outside corners was given in the description of FIG'S. 4–8. The only additional information that is considered desirable to mention here is that the flap portion will normally extend 4 to 6 cm. past the remaining core at the side of the panel. Thus, to install the first panel in place it will first be cut about 5 cm. longer that desired to fit against the first cross-bar part of the edging member when such is properly installed, a score line will be made along the desired length of the panel and the excess back base cover and core material will be removed, leaving the flap to be wrapped around the edging member. Usually, for thermoplastic cover sheets or fabrics, heating may be used to help to "train" the thermoplastic material around the corner but such often is unnecessary and sometimes may not be desirable.

The advantages of the present invention have been alluded to previously but will be reiterated now in somewhat more detail. The present corner constructions may be easily made, are adaptable for use with vertical, horizontal and other corners, utilize inexpensive edging strips which can be employed for both left to right and right to left corner installations (by inverting the strip), are almost foolproof, for installation by unskilled personnel, and produce attractive, straight strong, and impact resistant corners to protect the relatively fragile wallboard panels. However, although all such advantages are important, of primary importance is the fact that the corner constructions made are inconspicuous, with no seam or dividing line showing at all on one of the panels of the corner, and with a perfect match being made with the pre-finished surfaces of both panels. Contrast this with the situation when typical corner moldings are employed, in which cases a wide variety of colors and patterns of such moldings will have to be stocked and on hand at the job site so as to make corners which would not be objectionably conspicuous. Alternatively, such corners will have to be covered with fabrics resembling the pre-finish cover on the wallboard panels, which will also require the stocking of a number of different types of cover materials to allow for changes in the panel finishes in different areas of the building. With the present invention no such stockings of different edging members or materials is required and excellent matches are automatically obtained without difficulty. Furthermore, the edges resulting are neat, straight and attractive and the edging members effectively hold the panels in position and result in strong corners even when the sides of the panels may not be completely inserted so as to bear against corresponding edging member parts. In addition to advantages in appearance and function, as well as the advantages in inventory control (no large inventories of different patterns, no color matching, no shortages of particular covers and no odd leftovers), another significant advantage of the present invention is that it is also more economical that other protective corners for wallboard panel assemblies. Also, it is considered that a trained installer can put in the present corner constructions in about the same or less time than it takes for less attractive "prior art" covers. Additionally, the edging members of this invention are adaptable for use with both pre-finished and "ordinary" paper surfaced wallboard panels.

The invention has been described with respect to various descriptions and illustrations of preferred embodiments thereof but it is not to be limited to these because it is evident that one of skill in the art, with the present specification and drawings before him, will be able to utilize substitutes and equivalents without departing from the invention.

What is claimed is:

1. An outside longitudinal corner construction of wallboard panels which comprises a longitudinally extending framing member having first and second surfaces at about a right angle to each other and extending in the direction of the corner, a pair of wallboard panels, each having core portions covered by cover fabrics or sheets, and an edging member which extends longitudinally in the direction of the framing member and is held to it, directly or indirectly, along its length, said edging member being essentially T-shaped in cross-section or having a part thereof which is essentially T-shaped in cross-section, with a post section and a cross-bar section, said post section or an extension of it being held directly or indirectly to the framing member, a first part of the cross-bar extending from the post in a direction a distance from the first surface of the framing member about the thickness of a wallboard and a second part of the cross-bar extending in an opposite direction from the post, with both cross-bar sections being at a distance from the second surface of the framing member or an extension of the plane thereof about equal to a wallboard thickness plus a wallboard cover thickness, the first wallboard panel being held to the first surface of the framing member and near or against the first part of the edging member cross-bar, with a cover fabric or sheet thereof, which extends beyond said wallboard and said cross-bar, as a flap, being wrapped about the cross-bar, and with the second wallboard panel having a side thereof positioned between the second cross-bar and the second framing member surface and adjacent the edging member post, and holding the cover fabric or sheet of the first wallboard panel in position between the second cross-bar part and the second wallboard panel.

2. A corner construction according to claim 1 wherein the wallboards are pre-finished gypsum core wallboards pre-finished on a major surface thereof with a flexible covering material, the framing member is a wooden, plastic or metal stud of substantially rectangular shape for the wooden and plastic studs and of substantially C-shape for the metal stud, the edging member is a synthetic organic polymeric plastic or metal edging strip and the corner construction is that of a vertical corner for a pair of wallboard wall panels which meet at a right angle.

3. A corner construction according to claim 2 wherein the T-shaped edging strip is molded, extruded or formed, essentially from a form-retaining synthetic organic polymeric plastic and the covering on at least the first wallboard is of vinyl plastic.

4. A corner construction according to claim 3 wherein the T-shaped edging member comprises an auxiliary cross-bar extending from the post in the direction in which the second cross-bar part extends, which is located a distance away from the second cross-bar part which is such that a second wallboard panel and the cover flap from the first wallboard panel may be inserted therebetween and will be held tightly in place.

5. A corner construction according to claim 4 wherein the end portion of the auxiliary cross-bar is inclined toward the plane of the edging member cross-bar and is sufficiently flexible so as to accommodate different second wallboard thicknesses while still holding the second wallboard and the cover flap from the first wallboard tightly in place.

6. A corner construction according to claim 2 wherein the first face of the framing member is of longitudinal channel construction having a depressed area and the post section of the T is shaped to conform to such construction depression.

7. A corner construction according to claim 1 wherein the first wallboard is fastened to the framing member at the first side thereof by a plurality of fasteners located under the cover fabric or sheet of which the flap is an extension.

8. A corner construction according to claim 1 wherein the flap of cover fabric or sheet from the first wallboard panel is adhesively secured to the edging member cross-bar.

9. A corner construction according to claim 1 wherein the cover fabric or sheet is paper, the flap thereof is paper and the flap and a portion of the second wallboard panel are covered with plaster or joint compound to form a smooth and continuous surface.

* * * * *